US005852836A

United States Patent [19]

Montrose

[11] Patent Number: 5,852,836

[45] Date of Patent: Dec. 29, 1998

[54] PORTABLE SHOWER

[76] Inventor: Doug Montrose, P.O. Box 1921, Elko, Nev. 89803

[21] Appl. No.: 897,895

[22] Filed: Jul. 21, 1997

[51] Int. Cl.[6] ..... A47K 3/22

[52] U.S. Cl. ..... 4/603; 4/602; 4/615; 4/616

[58] Field of Search ..... 4/603, 602, 601, 4/615, 616

[56] References Cited

U.S. PATENT DOCUMENTS

| | | | |
|---|---|---|---|
| 4,453,280 | 6/1984 | Greenleaf | 4/603 |
| 5,111,538 | 5/1992 | Chapman | 4/603 |
| 5,251,345 | 10/1993 | Pechner | 4/603 |

FOREIGN PATENT DOCUMENTS

| | | | |
|---|---|---|---|
| 3230461 | 2/1984 | Germany | 4/603 |
| 405068653 | 3/1993 | Japan | 4/616 |

*Primary Examiner*—Robert M. Fetsuga
*Assistant Examiner*—Tuan Nguyen

[57] ABSTRACT

A new Portable Shower for ALLOWING A PERSON TO SHOWER WHILE OUTDOORS. The inventive device includes a cylindrical container having an open top, a closed bottom and a cylindrical side wall therebetween. A cover is removably positioned over the open top of the container. An aperture extends through the cover offset from a center thereof. A battery is positioned within the container. A pump is secured to an interior surface of the closed bottom of the container. The pump is in electrical communication with the battery. The pump has a water outlet. A flexible interior hose has a lower end coupled with the water outlet of the pump and an upper end coupled with the aperture of the cover. An elongated tube is provided comprising a plurality of separable segments. A lower end of the tube couples with the upper end of the flexible interior hose within the aperture of the cover. A shower head couples with an upper end of the elongated tube.

9 Claims, 2 Drawing Sheets

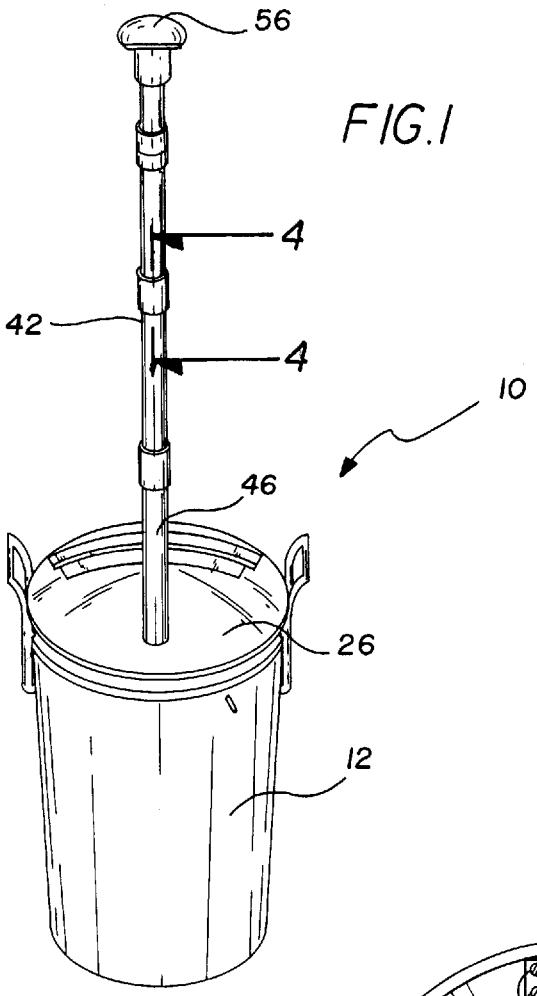
FIG.1
FIG.2
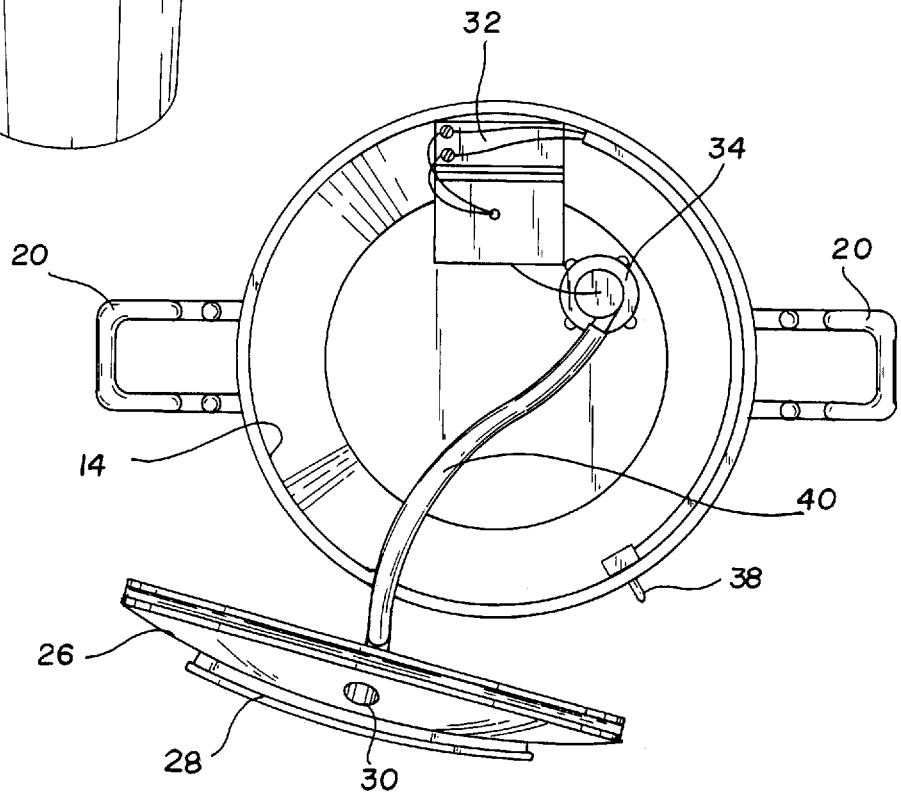

PORTABLE SHOWER

BACKGROUND OF THE INVENTION

1. Field of the Invention

The present invention relates to CONVERTIBLE SHOWERS and more particularly pertains to a new Portable Shower for ALLOWING A PERSON TO SHOWER WHILE OUTDOORS.

2. Description of the Prior Art

The use of CONVERTIBLE SHOWERS is known in the prior art. More specifically, CONVERTIBLE SHOWERS heretofore devised and utilized are known to consist basically of familiar, expected and obvious structural configurations, notwithstanding the myriad of designs encompassed by the crowded prior art which have been developed for the fulfillment of countless objectives and requirements.

Known prior art CONVERTIBLE SHOWERS include U.S. Pat. No. 5,111,538 to Chapman; U.S. Pat. No. 5,161,266 to Hildebrand; U.S. Pat. No. 4,539,720 to Westerwellerr; U.S. Pat. No. 4,453,280 to Green leaf; U.S. Pat. No. 3,925,828 to Kim; and U.S. Pat. No. Des. 339,860 to Hildebrand.

While these devices fulfill their respective, particular objectives and requirements, the aforementioned patents do not disclose a new Portable Shower. The inventive device includes a cylindrical container having an open top, a closed bottom and a cylindrical side wall therebetween. A cover is removably positioned over the open top of the container. An aperture extends through the cover offset from a center thereof. A battery is positioned within the container. A pump is secured to an interior surface of the closed bottom of the container. The pump is in electrical communication with the battery. The pump has a water outlet. A flexible interior hose has a lower end coupled with the water outlet of the pump and an upper end coupled with the aperture of the cover. An elongated tube is provided comprising a plurality of separable segments. A lower end of the tube couples with the upper end of the flexible interior hose within the aperture of the cover. A shower head couples with an upper end of the elongated tube.

In these respects, the Portable Shower according to the present invention substantially departs from the conventional concepts and designs of the prior art, and in so doing provides an apparatus primarily developed for the purpose of ALLOWING A PERSON TO SHOWER WHILE OUTDOORS.

SUMMARY OF THE INVENTION

In view of the foregoing disadvantages inherent in the known types of CONVERTIBLE SHOWERS now present in the prior art, the present invention provides a new Portable Shower construction wherein the same can be utilized for ALLOWING A PERSON TO SHOWER WHILE OUTDOORS. The general purpose of the present invention, which will be described subsequently in greater detail, is to provide a new Portable Shower apparatus and method which has many of the advantages of the CONVERTIBLE SHOWERS mentioned heretofore and many novel features that result in a new Portable Shower which is not anticipated, rendered obvious, suggested, or even implied by any of the prior art CONVERTIBLE SHOWERS, either alone or in any combination thereof.

To attain this, the present invention generally comprises a cylindrical container having an open top, a closed bottom and a cylindrical side wall therebetween. The side wall has a pair of diametrically opposed handles pivotally disposed thereon downwardly of the open top. The container has a shelf secured to an interior surface of the cylindrical side wall disposed adjacent to the open top. The shelf has an upwardly extending wall. A cover is removably positioned over the open top of the container. The cover is engaged by the handles in a locked orientation. The cover has a grasping handle integrally formed therewith. An aperture extends through the cover offset from a center thereof. A battery is positioned on the shelf of the container between the upwardly extending wall and the cylindrical side wall. A pump is secured to an interior surface of the closed bottom of the container. The pump is in electrical communication with the battery. The pump having a water outlet. A power switch is disposed within the cylindrical side wall of the container disposed downwardly of the open top. The power switch is in electrical communication with the battery. A flexible interior hose is provided having a lower end coupled with the water outlet of the pump and an upper end coupled with the aperture of the cover. An elongated tube is provided comprising a plurality of separable segments. The separable segments include an upper segment, a lower segment and an intermediate segment therebetween. A lower end of the lower segment couples with the upper end of the flexible interior hose within the aperture of the cover. An upper end of each of the segments have a collar disposed thereon. The collar has a pair of opposed grooves formed therein. A lower end of each of the segments, save the lower segment, have a pair of opposed protuberances extending outwardly thereof for mating with the opposed grooves on the collars. A shower head couples with the collar of the upper segment of the elongated tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Portable Shower apparatus and method which has many of the advantages of the CONVERTIBLE SHOWERS mentioned heretofore and many novel features that result in a new Portable Shower which is not anticipated, rendered obvious, suggested, or even implied by any of the prior art CONVERTIBLE SHOWERS, either alone or in any combination thereof.

It is another object of the present invention to provide a new Portable Shower which may be easily and efficiently manufactured and marketed.

It is a further object of the present invention to provide a new Portable Shower which is of a durable and reliable construction.

An even further object of the present invention is to provide a new Portable Shower which is susceptible of a low cost of manufacture with regard to both materials and labor, and which accordingly is then susceptible of low prices of sale to the consuming public, thereby making such Portable Shower economically available to the buying public.

Still yet another object of the present invention is to provide a new Portable Shower which provides in the apparatuses and methods of the prior art some of the advantages thereof, while simultaneously overcoming some of the disadvantages normally associated therewith.

Still another object of the present invention is to provide a new Portable Shower for ALLOWING A PERSON TO SHOWER WHILE OUTDOORS.

Yet another object of the present invention is to provide a new Portable Shower which includes a cylindrical container having an open top, a closed bottom and a cylindrical side wall therebetween. A cover is removably positioned over the open top of the container. An aperture extends through the cover offset from a center thereof. A battery is positioned within the container. A pump is secured to an interior surface of the closed bottom of the container. The pump is in electrical communication with the battery. The pump has a water outlet. A flexible interior hose has a lower end coupled with the water outlet of the pump and an upper end coupled with the aperture of the cover. An elongated tube is provided comprising a plurality of separable segments. A lower end of the tube couples with the upper end of the flexible interior hose within the aperture of the cover. A shower head couples with an upper end of the elongated tube.

Still yet another object of the present invention is to provide a new Portable Shower that would hold a quantity of water sufficient for multiple hours of use.

Even still another object of the present invention is to provide a new Portable Shower that is fully self-contained.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new Portable Shower according to the present invention.

FIG. 2 is a top plan view of the present invention illustrating the interior of the container.

DESCRIPTION OF THE PREFERRED EMBODIMENT

Figure 3:
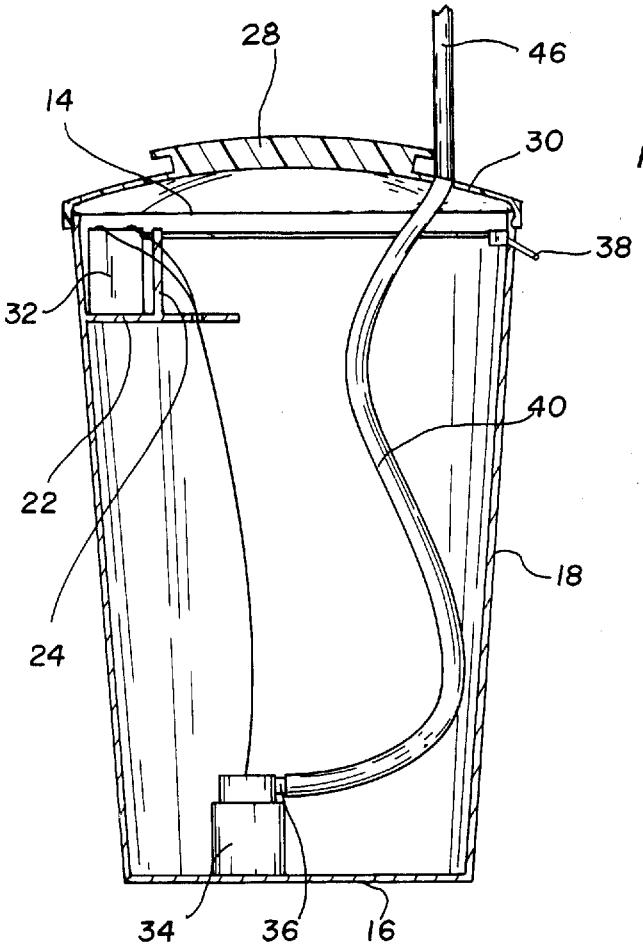
FIG. 3 is a cross-sectional side view of the present invention.
Figure 4:
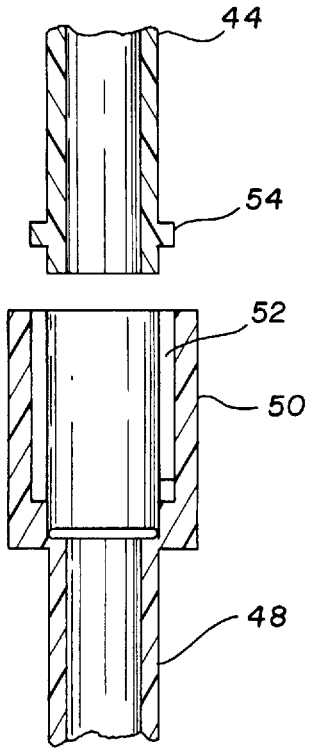
FIG. 4 is a cross-sectional view of the present invention as taken along line 4—4 of FIG. 1.

With reference now to the drawings, and in particular to FIGS. 1 through 4 thereof, a new Portable Shower embodying the principles and concepts of the present invention and generally designated by the reference numeral 10 will be described.

As best illustrated in FIGS. 1 through 4, the Portable Shower 10 comprises a cylindrical container 12 having an open top 14, a closed bottom 16 and a cylindrical side wall 18 therebetween. The side wall 18 has a pair of diametrically opposed handles 20 pivotally disposed thereon downwardly of the open top 14. The container 12 has a shelf 22 secured to an interior surface of the cylindrical side wall 18 disposed adjacent to the open top 14. The shelf 22 has an upwardly extending wall 24.

A cover 26 is removably positioned over the open top 14 of the container 12. The cover 26 is engaged by the handles 20 in a locked orientation. The cover 26 has a grasping handle 28 integrally formed therewith. An aperture 30 extends through the cover 26 offset from a center thereof.

A battery 32 is positioned on the shelf 22 of the container 12 between the upwardly extending wall 24 and the cylindrical side wall 18.

A pump 34 is secured to an interior surface of the closed bottom 16 of the container 12. The pump 34 is in electrical communication with the battery 32. The pump 34 having a water outlet 36.

A power switch 38 is disposed within the cylindrical side wall 18 of the container 12 disposed downwardly of the open top 14. The power switch 38 is in electrical communication with the battery 32.

A flexible interior hose 40 is provided having a lower end coupled with the water outlet 36 of the pump 34 and an upper end coupled with the aperture 30 of the cover 26.

An elongated tube 42 is provided comprising a plurality of separable segments. The separable segments include an upper segment 44, a lower segment 46 and an intermediate segment 48 therebetween. A lower end of the lower segment 46 couples with the upper end of the flexible interior hose 40 within the aperture 30 of the cover 26. An upper end of each of the segments have a collar 50 disposed thereon. The collar 50 has a pair of opposed grooves 52 formed therein. A lower end of each of the segments, save the lower segment 46, have a pair of opposed protuberances 54 extending outwardly thereof for mating with the opposed grooves 52 on the collars 50.

A shower head 56 couples with the collar of the upper segment 44 of the elongated tube 42.

In use, the container 12 is filled with warm water. The cover 26 is put in place over the open top 14 of the container 12 with the handles 20 of the container 12 engaging the cover 26. The elongated tube 42 is assembled to the desired height suitable to a user and then secured to the flexible hose 40. The shower head 56 is then coupled with the upper segment 44 of the elongated tube 42. The power switch 38 is then turned to the "on" position which will activate the pump 34. The pump 34 will force the warm water, or any temperature desired, out through the flexible hose 40 and through the elongated tube 42 to be sprayed outwardly of the shower head 56.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all is equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable shower comprising:

a cylindrical container having an open top, a closed bottom, a cylindrical side wall therebetween, the side wall having a pair of diametrically opposed handles pivotally disposed thereon downwardly of the open top;

a cover removably positioned over the open top of the container, the cover being engaged by the handles in a locked orientation, the cover having a grasping handle integrally formed therewith, an aperture extending through the cover offset from a center thereof;

a battery positioned within the container, said battery being positioned proximate said top opening such that said battery is supported above a top of an amount of water held in the container, said battery further being positioned such that the cover is positionable over the open top when the battery is positioned in the container;

a pump secured to an interior surface of the closed bottom of the container, the pump being in electrical communication with the battery, the pump having a water outlet;

a flexible interior hose having a lower end coupled with the water outlet of the pump;

an elongated tube comprising a plurality of separable segments, a lower end of the tube being coupled to an upper end of the flexible interior hose such that the lower segment is in environmental communication with the flexible interior hose through the aperture in the cover, the lower end of the lower segment and the upper end of the flexible interior hose each being coupled to the cover around the aperture such that each is secured to the cover during use; and a shower head coupled to an upper end of the elongated tube.

2. The portable shower as set forth in claim 1 and further including a power switch disposed on the cylindrical side wall of the container disposed downwardly of the open top, the power switch being in electrical communication with the battery.

3. The portable shower as set forth in claim 1 wherein the container has a shelf secured to an interior surface of the cylindrical side wall disposed adjacent to the open top, the shelf having an upwardly extending wall, the shelf supporting the battery thereon such that the battery is supported within the container without interfering with the placement of the cover on the container, the battery being disposed between the upwardly extending wall and the cylindrical side wall.

4. The portable shower as set forth in claim 1 wherein the separable segments include an upper segment, a lower segment and an intermediate segment therebetween, an upper end of each of the segments having a collar disposed thereon, the collar having a pair of opposed grooves formed therein, a lower end of each of the segments save the lower segment having a pair of opposed protuberances extending outwardly thereof for mating with the opposed grooves on the collars.

5. A substantially self-contained portable shower comprising:

a cylindrical container having an open top, a closed bottom and a cylindrical side wall therebetween;

a cover removably positioned over the open top of the container, an aperture extending through the cover offset from a center thereof;

a battery shelf positioned within the container, said battery shelf being mounted on said cylindrical side wall in a position proximate to said top opening such that a battery placed in said battery shelf is located above a top surface of an amount of water held in the container;

a pump positioned in the container and secured to an interior surface of the closed bottom of the container, the pump being in electrical communication with the battery, the pump having a water outlet;

a flexible interior hose having a lower end coupled to the water outlet of the pump and an upper end coupled to said cover about the aperture of the cover such that said interior hose is in fluid communication with said aperture;

an elongated tube comprising a plurality of separable segments, a lower end of the tube being coupled to said cover about said aperture such that said tube is in fluid communication with said aperture and said interior hose; and a shower head coupled to an upper end of the elongated tube.

6. The portable shower as set forth in claim 5 and further including a power switch disposed on the cylindrical side wall of the container disposed downwardly of the open top, the power switch being in electrical communication with the battery.

7. The portable shower as set forth in claim 5 wherein the battery shelf comprises a shelf secured to an interior surface of the cylindrical side wall disposed adjacent to the open top, the shelf having an upwardly extending wall for retaining the battery on said shelf the battery shelf being disposed between the upwardly extending wall and the cylindrical side wall at a level below the upper rim of said cylindrical side wall such that the battery is supported within the container without interfering with the placement of the cover on the container.

8. The portable shower as set forth in claim 5 wherein the separable segments include an upper segment, a lower segment and an intermediate segment therebetween, [a lower end of the lower segment coupling with the upper end of the flexible interior hose within the aperture of the cover,]

an upper end of each of the segments having a collar disposed thereon, the collar having a pair of opposed grooves formed therein, a lower end of each of the segments save the lower segment having a pair of opposed protuberances extending outwardly thereof for mating with the opposed grooves on the collars.

9. A portable shower for allowing a person to shower while outdoors comprising, in combination:

a cylindrical container having an open top, a closed bottom and a cylindrical side wall therebetween, the side wall having a pair of diametrically opposed handles pivotally disposed thereon downwardly of the open top, the container having a shelf secured to an interior surface of the cylindrical side wall disposed adjacent to the open top, the shelf having an upwardly extending wall;

a cover removably positioned over the open top of the container, the cover being engaged by the handles in a locked orientation, the cover having a grasping handle integrally formed therewith, an aperture extending through the cover offset from a center thereof;

a battery positioned on the shelf of the container between the upwardly extending wall and the cylindrical side wall;

a pump secured to an interior surface of the closed bottom of the container, the pump being in electrical communication with the battery, the pump having a water outlet;

a power switch disposed on the cylindrical side wall of the container and disposed downwardly of the open top, the power switch being in electrical communication with the battery;

a flexible interior hose having a lower end coupled to the water outlet of the pump and an upper end coupled to said cover about the aperture of the cover such that said interior hose is in fluid communication with said aperture;

an elongated tube comprising a plurality of separable segments, the separable segments including an upper segment, a lower segment and an intermediate segment therebetween, a lower end of the lower segment being coupled to said cover about said aperture such that said tube is in fluid communication with said aperture and said interior hose, an upper end of each of the segments having a collar disposed thereon, the collar having a pair of opposed grooves formed therein, a lower end of each of the segments save the lower segment having a pair of opposed protuberances extending outwardly thereof for mating with the opposed grooves on the collars; and a shower head coupling with the collar of the upper segment of the elongated tube.

* * * * *